US008678752B2

(12) United States Patent
Delvaux et al.

(10) Patent No.: US 8,678,752 B2
(45) Date of Patent: Mar. 25, 2014

(54) ROTARY MACHINE HAVING NON-UNIFORM BLADE AND VANE SPACING

(75) Inventors: John McConnell Delvaux, Fountain Inn, SC (US); Brian Denver Potter, Greer, SC (US)

(73) Assignee: General Electric Company, Schenectady, NY (US)

( * ) Notice: Subject to any disclaimer, the term of this patent is extended or adjusted under 35 U.S.C. 154(b) by 619 days.

(21) Appl. No.: 12/908,824

(22) Filed: Oct. 20, 2010

(65) Prior Publication Data

US 2012/0099961 A1 Apr. 26, 2012

(51) Int. Cl.
*F01D 5/16* (2006.01)

(52) U.S. Cl.
USPC ..... 415/119; 415/194; 415/195; 416/203; 416/215

(58) Field of Classification Search
USPC ..... 415/194, 195; 416/176, 203, 119 R, 416/220 R, 212 A, 19 R
See application file for complete search history.

(56) References Cited

U.S. PATENT DOCUMENTS

| | | | | |
|---|---|---|---|---|
| 1,534,721 | A | 4/1925 | Lasche | |
| 2,916,257 | A * | 12/1959 | Poellmitz et al. | 416/220 R |
| 3,006,603 | A * | 10/1961 | Caruso et al. | 415/195 |
| 3,107,897 | A * | 10/1963 | Judge et al. | 416/191 |
| 4,084,922 | A * | 4/1978 | Glenn | 416/220 R |
| 4,175,912 | A * | 11/1979 | Crane et al. | 416/193 A |
| 4,474,534 | A | 10/1984 | Thode | |
| 5,000,660 | A | 3/1991 | Van Houten et al. | |
| 5,681,145 | A | 10/1997 | Neely et al. | |
| 6,402,458 | B1 * | 6/2002 | Turner | 415/1 |
| 6,439,838 | B1 | 8/2002 | Crall et al. | |
| 6,733,237 | B2 * | 5/2004 | Ingistov | 415/209.2 |
| 7,029,227 | B2 | 4/2006 | Berthillier et al. | |
| 7,367,775 | B2 * | 5/2008 | Borufka et al. | 415/119 |
| 7,743,497 | B2 | 6/2010 | Gautreau et al. | |
| 7,931,442 | B1 * | 4/2011 | Liang | 416/193 A |
| 8,206,097 | B2 * | 6/2012 | Nagai et al. | 415/195 |
| 8,277,166 | B2 * | 10/2012 | Tecza et al. | 415/1 |
| 2007/0079506 | A1 | 4/2007 | Gautreau et al. | |
| 2008/0112809 | A1 * | 5/2008 | Corral Garcia et al. | 416/189 |
| 2009/0047128 | A1 * | 2/2009 | Bracken et al. | 416/1 |

FOREIGN PATENT DOCUMENTS

| | | | |
|---|---|---|---|
| EP | 921274 | A2 * | 6/1999 |

* cited by examiner

*Primary Examiner* — Nathaniel Wiehe
*Assistant Examiner* — Justin Seabe
(74) *Attorney, Agent, or Firm* — Fletcher Yoder P.C.

(57) ABSTRACT

A system, including a rotary machine including: a stator, a rotor configured to rotate relative to the stator, wherein the rotor comprises a plurality of blades having a non-uniform spacing about a circumference of the rotor.

20 Claims, 5 Drawing Sheets

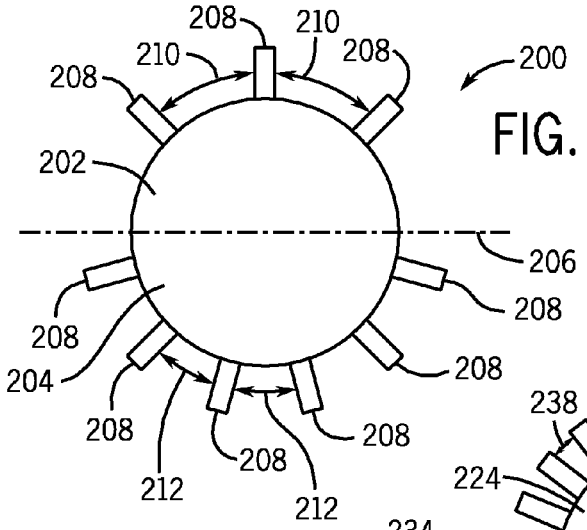
FIG. 2
FIG. 3
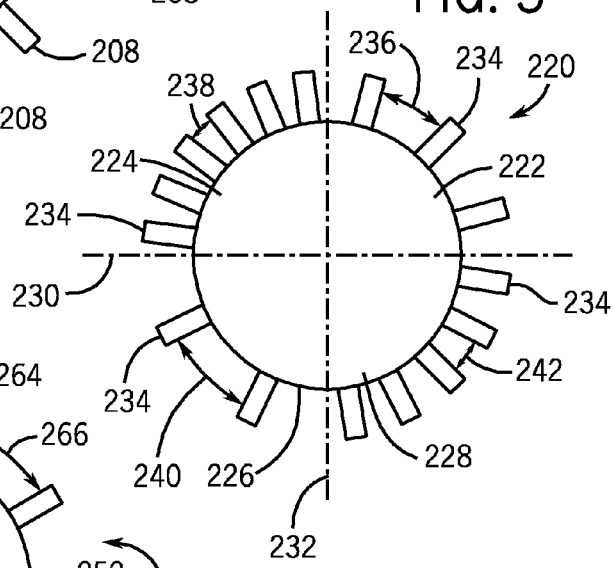
FIG. 4
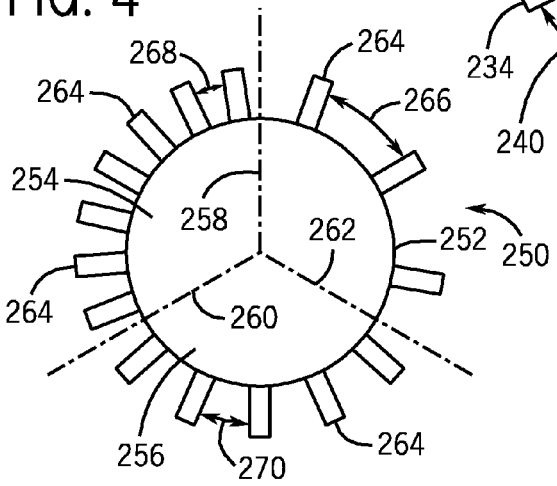
FIG. 5
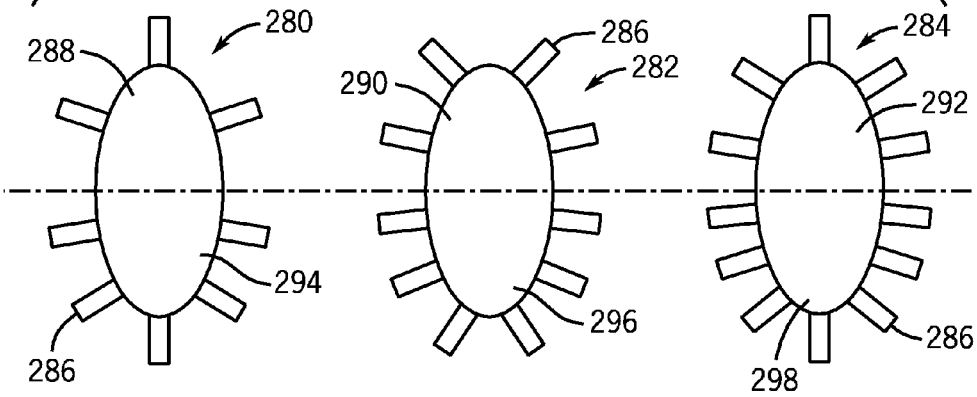

ROTARY MACHINE HAVING NON-UNIFORM BLADE AND VANE SPACING

BACKGROUND OF THE INVENTION

The subject matter disclosed herein relates to rotary machines and, more particularly, turbines and compressors having blades and vanes disposed about a respective rotor or a stator.

Turbine engines extract energy from a flow of fluid and convert the energy into useful work. For example, a gas turbine engine combusts a fuel-air mixture to generate hot combustion gases, which then flow through turbine blades to drive a rotor. Unfortunately, the rotating turbine blades create wakes and bow waves, which can excite stationary structures in the gas turbine engine. For example, the wakes and bow waves may cause vibration, premature wear, and damage of stationary vanes, nozzles, airfoils, rotors, other blades etc. in the path of the hot combustion gases. Furthermore, the periodic nature of the wakes and bow waves may create resonant behavior in the gas turbine engine, thereby producing increasingly larger amplitude oscillations in the gas turbine engine.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a rotary machine having a stator and a rotor configured to rotate relative to the stator, wherein the rotor has a plurality of blades with a non-uniform spacing about a circumference of the rotor.

In a second embodiment, an apparatus includes a rotary machine having a first stage with a plurality of first blades configured to rotate about an axis, and a second stage with a plurality of second blades configured to rotate about the axis. The plurality of second blades is offset relative to the plurality of first blades along the axis, and at least one of the plurality of first blades or the plurality of second blades has a non-uniform blade spacing about the axis.

In a third embodiment, a system includes a turbine engine having a plurality of first blades configured to rotate about a first axis and a plurality of second blades configured to rotate about a second axis, wherein at least one of the plurality of first blades or the plurality of second blades has a non-uniform blade spacing.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein:

FIG. 2 is a front view of an embodiment of a rotor with a non-uniform spacing of blades;

FIG. 3 is a front view of an embodiment of a rotor with a non-uniform spacing of blades;

FIG. 4 is a front view of an embodiment of a rotor with a non-uniform spacing of blades;

FIG. 5 is a perspective view of an embodiment of three rotors, wherein each rotor has a different non-uniform spacing of blades;

DETAILED DESCRIPTION OF THE INVENTION

Figure 1:
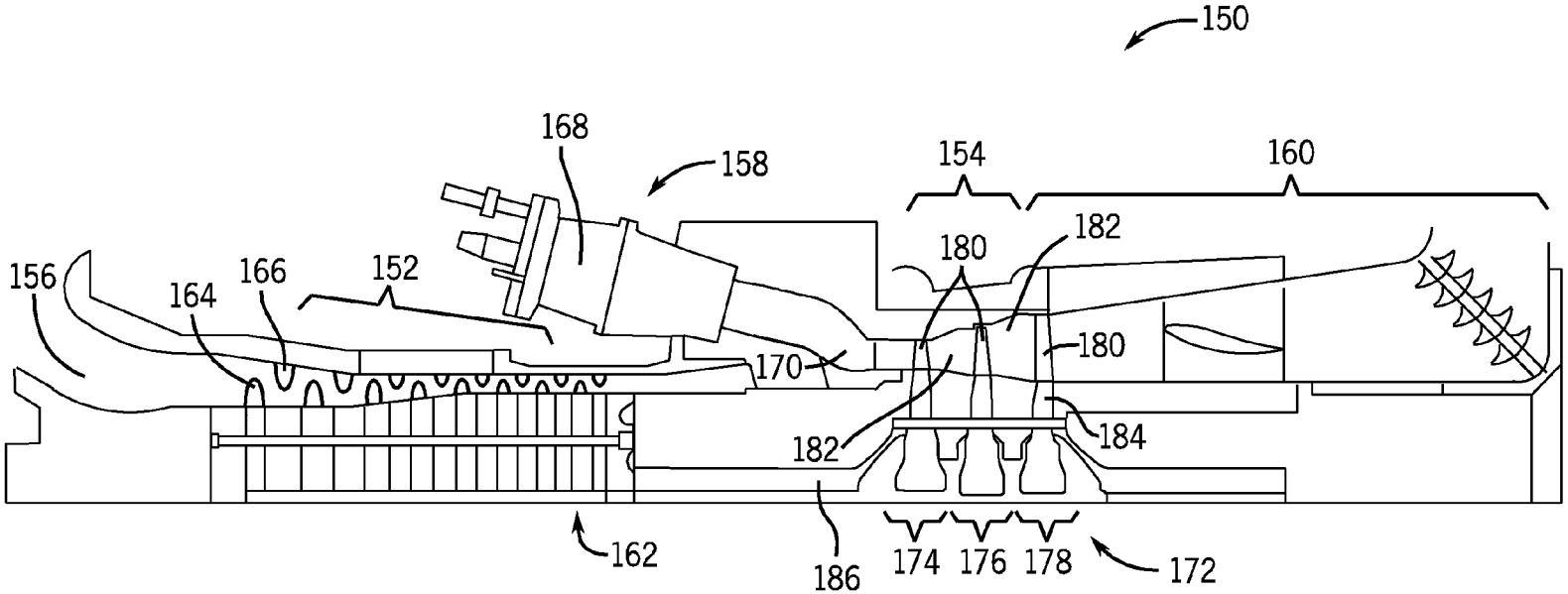
FIG. 1 is a sectional view of an embodiment of a gas turbine engine of FIG. 1 sectioned through the longitudinal axis.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The disclosed embodiments are directed to a non-uniform spacing of blades and/or vanes in a rotary machine, such as a turbine or a compressor, to reduce the development of wakes and bow waves by a rotating airfoil or structure. As discussed below, the non-uniform spacing of the blades and/or vanes reduces or eliminates the periodic nature of the wakes and bow waves, thereby reducing the possibility of resonant behavior in the rotary machine. In other words, the non-uniform spacing of the blades and/or vanes may reduce or eliminate the ability of the wakes and bow waves to increase in amplitude due to a periodic spacing of the blades and/or vanes, and thus a periodic driving force of the wakes and bow waves. Instead, the non-uniform spacing of the blades and/or vanes may dampen and reduce the response of structures in the flow path (e.g., vanes, blades, stators, rotors, etc.) due to the non-periodic generation of wake and bow waves. In certain embodiments, the non-uniform spacing of the blades and/or vanes may be achieved with differently sized spacers between adjacent blades and/or vanes, differently sized bases of adjacent blades and/or vanes, or any combination thereof. The non-uniform spacing of the blades and/or vanes may include both non-uniform spacing of the blades and/or vanes about a circumference of a particular stage (e.g., turbine or compressor stage), non-uniform spacing of the blades and/or vanes from one stage to another, or a combination thereof. The non-uniform blade and/or vane spacing effectively reduces and dampens the wake and bow waves generated by the blades and/or vanes, thereby reducing the possibility of vibration, premature wear, and damage caused by such wakes and bow waves on stationary airfoils or structures. While the following embodiments are discussed in the context of a gas turbine, it is understood that any turbine may employ non-uniform blade and/or vane spacing to dampen and reduce resonant behavior in stationary parts. Furthermore, the disclosure is intended to cover rotary machines that move fluids other than air such as water, steam, etc.

The disclosed embodiments of non-uniform spacing of rotating blades or stationary vanes may be utilized in any suitable rotary machine, such as turbines, compressors, and rotary pumps. However, for purposes of discussion, the disclosed embodiments are presented in context of a gas turbine engine. FIG. 1 is a cross-sectional side view of an embodiment of a gas turbine engine 150. As described further below, a non-uniform spacing of rotating blades or stationary vanes may be employed within the gas turbine engine 150 to reduce and/or dampen periodic oscillations, vibration, and/or harmonic behavior of wake and bow waves in the fluid flow. For example, a non-uniform spacing of rotating blades or stationary vanes may be used in a compressor 152 and a turbine 154 of the gas turbine engine 150. Furthermore, the non-uniform spacing of rotating blades or stationary vanes may be used in a single stage or multiple stages of the compressor 152 and the turbine 154, and may vary from one stage to another.

In the illustrated embodiment, the gas turbine engine 150 includes an air intake section 156, the compressor 152, one or more combustors 158, the turbine 154, and an exhaust section 160. The compressor 152 includes a plurality of compressor stages 162 (e.g., 1 to 20 stages), each having a plurality of rotating compressor blades 164 and stationary compressor vanes 166. The compressor 152 is configured to intake air from the air intake section 156 and progressively increase the air pressure in the stages 162. Eventually, the gas turbine engine 150 directs the compressed air from the compressor 152 to the one or more combustors 158. Each combustor 158 is configured to mix the compressed air with fuel, combust the fuel air mixture, and direct hot combustion gases toward the turbine 154. Accordingly, each combustor 158 includes one or more fuel nozzles 168 and a transition piece 170 leading toward the turbine 154. The turbine 154 includes a plurality of turbine stages 172 (e.g., 1 to 20 stages), such as stages 174, 176, and 178, each having a plurality of rotating turbine blades 180 and stationary nozzle assemblies or turbine vanes 182. In turn, the turbine blades 180 are coupled to respective turbine wheels 184, which are coupled to a rotating shaft 186. The turbine 154 is configured to intake the hot combustion gases from the combustors 158, and progressively extract energy from the hot combustion gases to drive the blades 180 in the turbine stages 172. As the hot combustion gases cause rotation of the turbine blades 180, the shaft 186 rotates to drive the compressor 152 and any other suitable load, such as an electrical generator. Eventually, the gas turbine engine 150 diffuses and exhausts the combustion gases through the exhaust section 160.

As discussed in detail below, a variety of embodiments of non-uniformly spaced rotating blades or stationary vanes may be used in the compressor 152 and the turbine 154 to tune the fluid dynamics in a manner that reduces undesirable behavior, such as resonance and vibration. For example, as discussed with reference to FIGS. 2-14, a non-uniform spacing of the compressor blades 164, the compressor vanes 166, the turbine blades 180, and/or the turbine vanes 182 may be selected to reduce, dampen, or frequency shift the wake and bow waves created in the gas turbine engine 150. In these various embodiments, the non-uniform spacing of rotating blades or stationary vanes is specifically selected to reduce the possibility of resonance and vibration, thereby improving the performance and increasing the longevity of the gas turbine engine 150.

FIG. 2 is a front view of an embodiment of a rotor 200 with non-uniformly spaced blades. In certain embodiments, the rotor 200 may be disposed in a turbine, a compressor, or another rotary machine. For example, the rotor 200 may be disposed in a gas turbine, a steam turbine, a water turbine, or any combination thereof. Furthermore, the rotor 200 may be used in multiple stages of a rotary machine, each have the same or different arrangement of the non-uniformly spaced blades.

The illustrated rotor 200 has non-uniformly spaced blades 208, which may be described by dividing the rotor 200 into two equal sections 202 and 204 (e.g., 180 degrees each) via an intermediate line 206. In certain embodiments, each section 202 and 204 may have a different number of blades 208, thereby creating non-uniform blade spacing. For example, the illustrated upper section 202 has three blades 208, while the illustrated lower section 204 has six blades 208. Thus, the upper section 202 has half as many blades 208 as the lower section 204. In other embodiments, the upper and lower sections 202 and 204 may differ in the number of blades 208 by approximately 1 to 1.005, 1 to 1.01, 1 to 1.02, 1 to 1.05, or 1 to 3. For example, the percentage of blades 208 of the upper section 202 relative to the lower section 204 may range between approximately 50 to 99.99 percent, 75 to 99.99 percent, 95 to 99.99, or 97-99.99 percent. However, any difference in the number of blades 208 between the upper and lower sections 202 and 204 may be employed to reduce and dampen wakes and bow waves associated with rotation of the blades 208 on structures in the flow path.

In addition, the blades 208 may be evenly or unevenly spaced within each section 202 and 204. For example, in the illustrated embodiment, the blades 208 in the upper section 202 are evenly spaced from one another by a first circumferential spacing 210 (e.g., arc lengths), while the blades 208 in the lower section 204 are evenly spaced from one another by a second circumferential spacing 212 (e.g., arc lengths). Although each section 202 and 204 has equal spacing, the circumferential spacing 210 is different from the circumferential spacing 212. In other embodiments, the circumferential spacing 210 may vary from one blade 208 to another in the upper section 202 and/or the circumferential spacing 212 may vary from one blade 208 to another in the lower section 204. In each of these embodiments, the non-uniform blade spacing is configured to reduce the possibility of resonance on stationary airfoils and structures due to periodic generation of wakes and bow waves by rotating airfoils or structures. The non-uniform blade spacing may effectively dampen and reduce the wakes and bow waves due to their non-periodic generation by the non-uniform rotating airfoils or structures. In this manner, the non-uniform blade spacing is able to lessen the impact of wakes and bow waves on various upstream/downstream components, e.g., vanes, blades, nozzles, stators, rotors, airfoils, etc.

FIG. 3 is a front view of an embodiment of a rotor 220 with non-uniformly spaced blades. In certain embodiments, the rotor 220 may be disposed in a turbine, a compressor, or another rotary machine. For example, the rotor 220 may be disposed in a gas turbine, a steam turbine, a water turbine, or any combination thereof. Furthermore, the rotor 220 may be used in multiple stages of a rotary machine, each have the same or different arrangement of the non-uniformly spaced blades.

The illustrated rotor 220 has non-uniformly spaced blades 234, which may be described by dividing the rotor 220 into four equal sections 222, 224, 226, and 228 (e.g., 90 degrees each) via intermediate lines 230 and 232. In certain embodiments, at least one or more of the sections 222, 224, 226, and 228 may have a different number of blades 234 relative to the other sections, thereby creating non-uniform blade spacing. For example, the sections 222, 224, 226, and 228 may have 1, 2, 3, or 4 different numbers of blades 234 in the respective sections. In the illustrated embodiment, each section 222, 224, 226, and 228 has a different number of blades 234. Section 222 has 3 blades equally spaced from one another by a circumferential distance 236, section 224 has 6 blades equally spaced from one another by a circumferential distance 238, section 226 has 2 blades equally spaced from one another by a circumferential distance 240, and section 228 has 5 blades equally spaced from one another by a circumferential distance 242. In this embodiment, sections 224 and 226 have an even yet different number of blades 234, while sections 222 and 228 have an odd yet different number of blades 234. In other embodiments, the sections 222, 224, 226, and 228 may have any configuration of even and odd numbers of blades 234, provided that at least one section has a different number of blades 234 relative to the remaining sections. For example, the sections 222, 224, 226, and 228 may vary in the number of blades 234 with respect to each other by approximately 1 to 1.005, 1 to 1.01, 1 to 1.02, 1 to 1.05, or 1 to 3.

In addition, the blades 234 may be evenly or unevenly spaced within each section 222, 224, 226, and 228. For example, in the illustrated embodiment, the blades 234 in the section 222 are evenly spaced from one another by the first circumferential spacing 236 (e.g., arc lengths), the blades 234 in the section 224 are evenly spaced from one another by the second circumferential spacing 238 (e.g., arc lengths), the blades 234 in the section 226 are evenly spaced from one another by the third circumferential spacing 240 (e.g., arc lengths), and the blades 234 in the section 228 are evenly spaced from one another by the fourth circumferential spacing 242 (e.g., arc lengths). Although each section 222, 224, 226, and 228 has equal spacing, the circumferential spacing 236, 238, 240, and 242 varies from one section to another. In other embodiments, the circumferential spacing may vary within each individual section. In each of these embodiments, the non-uniform blade spacing is configured to reduce the possibility of resonance due to periodic generation of wakes and bow waves. Furthermore, the non-uniform blade spacing may effectively dampen and reduce the response of structures in the flow path caused by the rotating airfoils or structure's wake and bow waves due to their non-periodic generation by the blades 234. In this manner, the non-uniform blade spacing is able to lessen the impact of wakes and bow waves on various upstream/downstream components, e.g., vanes, blades, nozzles, stators, rotors, airfoils, etc.

FIG. 4 is a front view of an embodiment of a rotor 250 with non-uniformly spaced blades. In certain embodiments, the rotor 250 may be disposed in a turbine, a compressor, or another rotary machine. For example, the rotor 250 may be disposed in a gas turbine, a steam turbine, a water turbine, or any combination thereof. Furthermore, the rotor 250 may be used in multiple stages of a rotary machine, each have the same or different arrangement of the non-uniformly spaced blades.

The illustrated rotor 250 has non-uniformly spaced blades 264, which may be described by dividing the rotor 250 into three equal sections 252, 254, and 256 (e.g., 120 degrees each) via intermediate lines 258, 260, and 262. In certain embodiments, at least one or more of the sections 252, 254, and 256 may have a different number of blades 264 relative to the other sections, thereby creating non-uniform blade spacing. For example, the sections 252, 254, and 256 may have 2 or 3 different numbers of blades 264 in the respective sections. In the illustrated embodiment, each section 252, 254, and 256 has a different number of blades 264. Section 252 has 3 blades equally spaced from one another by a circumferential distance 266, section 254 has 6 blades equally spaced from one another by a circumferential distance 268, and section 256 has 5 blades equally spaced from one another by a circumferential distance 270. In this embodiment, sections 252 and 256 have an odd yet different number of blades 264, while section 254 has an even number of blades 264. In other embodiments, the sections 252, 254, and 256 may have any configuration of even and odd numbers of blades 264, provided that at least one section has a different number of blades 264 relative to the remaining sections. For example, the sections 252, 254, and 256 may vary in the number of blades 264 with respect to each other by approximately 1 to 1.005, 1 to 1.01, 1 to 1.02, 1 to 1.05, or 1 to 3.

In addition, the blades 264 may be evenly or unevenly spaced within each section 252, 254, and 256. For example, in the illustrated embodiment, the blades 264 in the section 252 are evenly spaced from one another by the first circumferential spacing 266 (e.g., arc lengths), the blades 264 in the section 254 are evenly spaced from one another by the second circumferential spacing 268 (e.g., arc lengths), and the blades 264 in the section 256 are evenly spaced from one another by the third circumferential spacing 270 (e.g., arc lengths). Although each section 252, 254, and 256 has equal spacing, the circumferential spacing 266, 268, and 270 varies from one section to another. In other embodiments, the circumferential spacing may vary within each individual section. In each of these embodiments, the non-uniform blade spacing is configured to reduce the possibility of resonance due to periodic generation of wakes and bow waves. Furthermore, the non-uniform blade spacing may effectively dampen and reduce the response of structures in the flow path caused by the rotating airfoils or structure's wakes and bow waves due to their non-periodic generation by the blades 264. In this manner, the non-uniform blade spacing is able to lessen the impact of wakes and bow waves on various upstream/downstream components, e.g., vanes, blades, nozzles, stators, rotors, airfoils, etc.

FIG. 5 is a perspective view of an embodiment of three rotors 280, 282, and 284, wherein each rotor has a different non-uniform spacing of blades 286. For example, the illustrated rotors 280, 282, and 284 may correspond to three stages of the compressor 154 or the turbine 152 as illustrated in FIG. 1. As illustrated, each of the rotors 280, 282, and 284 has non-uniform spacing of blades 286 between respective upper sections 288, 290, and 292 and respective lower sections 294, 296, and 298. For example, the rotor 280 includes three blades 286 in the upper section 288 and five blades 286 in the lower section 294, the rotor 282 includes four blades 286 in the upper section 290 and six blades 286 in the lower section 296, and the rotor 284 includes five blades 286 in the upper section 292 and seven blades 286 in the lower section 298. Thus, the upper sections 280, 282, and 284 have a greater number of blades 286 relative to the lower sections 294, 296, and 298 in each respective rotor 280, 282, and 284. In the illustrated embodiment, the number of blades 286 increases by one blade 286 from one upper section to another, while also increasing by one blade 286 from one lower section to another. In other embodiments, the upper and lower sections may differ in the number of blades 286 by approximately 1 to 1.005, 1 to 1.01, 1 to 1.02, 1 to 1.05, or 1 to 3 within each individual rotor and/or from one rotor to another. In addition, the blades 286 may be evenly or unevenly spaced within each section 288, 290, 292, 294, 296, and 298.

In each of these embodiments, the non-uniform blade spacing is configured to reduce the possibility of resonance due to periodic generation of wakes and bow waves. Furthermore, the non-uniform blade spacing may effectively dampen and reduce the response of structures in the flow path caused by the rotating airfoils or structure's wake and bow waves due to their non-periodic generation by the blades 286. In this manner, the non-uniform blade spacing is able to lessen the impact of wakes and bow waves on various upstream/downstream components, e.g., vanes, blades, nozzles, stators, rotors, airfoils, etc. In the embodiment of FIG. 5, the non-uniform blade spacing is provided both within each individual rotor 280, 282, and 284, and also from one rotor to another (e.g., one stage to another). Thus, the non-uniformity from one rotor to another may further reduce the possibility of resonance caused by periodic generation of wakes and bow waves in a rotary machine.

Figure 6:
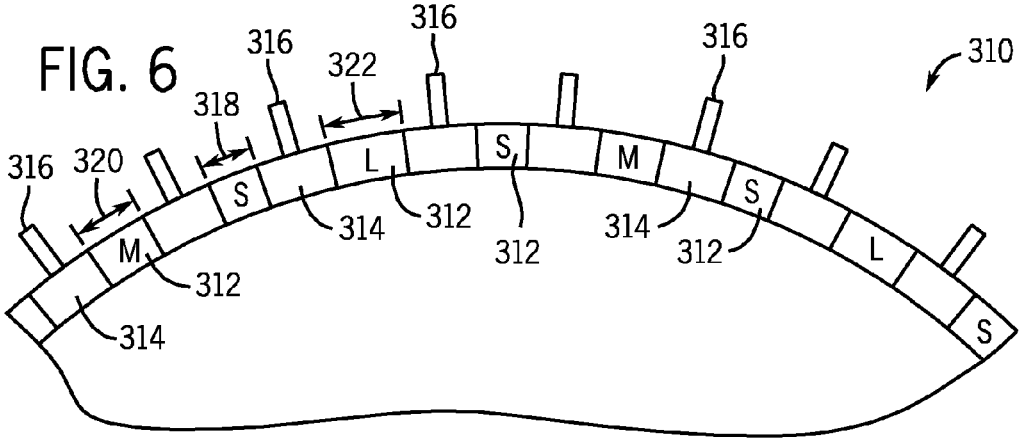
FIG. 6 is a section of a front view of an embodiment of a rotor with differently sized spacers between blades.

FIG. 6 is a section of a front view of an embodiment of a rotor 310 with differently sized spacers 312 between bases 314 of blades 316. In particular, the differently sized spacers 312 enable implementation of a variety of non-uniform blade spacing configurations with equally sized bases 314 and/or blades 316, thereby reducing manufacturing costs of the blades 316. Although any number and size of spacers 312 may be used to provide the non-uniform blade spacing, the illustrated embodiment includes three differently sized spacers 312 for purposes of discussion. The illustrated spacers 312 include a small spacer labeled as "S", a medium spacer labeled as "M", and a large spacer labeled as "L." The size of the spacers 312 may vary in a circumferential direction, as indicated by dimension 318 for the small spacer, dimension 320 for the medium spacer, and dimension 322 for the large spacer. In certain embodiments, a plurality of spacers 312 may be disposed between adjacent bases 314, wherein the spacers 312 are either of equal or different sizes. In other words, the differently sized spacers 312 may be either a one-piece construction or a multi-piece construction using a plurality of smaller spacers to generate a greater spacing. In either embodiment, the dimensions 318, 320, and 322 may progressively increase by a percentage of approximately 1 to 1000 percent, 5 to 500 percent, or 10 to 100 percent. In other embodiments, the rotor 310 may include more or fewer differently sized spacers 312, e.g., 2 to 100, 2 to 50, 2 to 25, or 2 to 10. The differently sized spacers 312 (e.g., S, M, and L) also may be arranged in a variety of repeating patterns, or they may be arranged in a random order.

Figure 7:
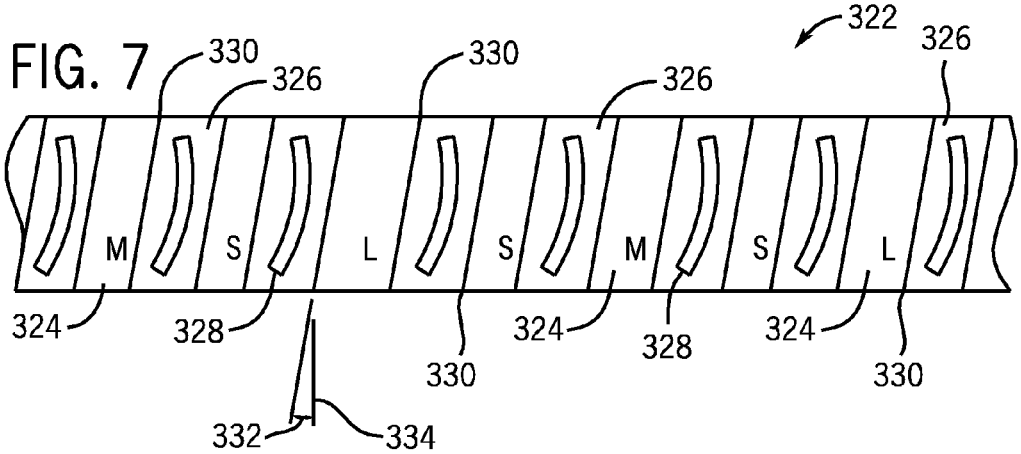
FIG. 7 is a top view of an embodiment of a rotor with differently sized spacers between blades.

FIG. 7 is a top view of an embodiment of a rotor 322 with differently sized spacers 324 between bases 326 of blades 328. Similar to the embodiment of FIG. 6, the differently sized spacers 324 enable implementation of a variety of non-uniform blade spacing configurations with equally sized bases 326 and/or blades 328, thereby reducing manufacturing costs of the blades 328. Although any number and size of spacers 324 may be used to provide the non-uniform blade spacing, the illustrated embodiment includes three differently sized spacers 324 for purposes of discussion. The illustrated spacers 324 include a small spacer labeled as "S", a medium spacer labeled as "M", and a large spacer labeled as "L." The size of the spacers 324 may vary in a circumferential direction, as discussed above with reference to FIG. 5. The differently sized spacers 324 (e.g., S, M, and L) also may be arranged in a variety of repeating patterns, or they may be arranged in a random order.

In the illustrated embodiment, the spacers 324 interface with the bases 326 of the blades 328 at an angled interface 330. For example, the angled interface 330 is oriented at an angle 332 relative to a rotational axis of the rotor 322, as indicated by line 334. The angle 332 may range between approximately 0 to 60 degrees, 5 to 45 degrees, or 10 to 30 degrees. The illustrated angled interface 330 is a straight edge or flat surface. However, other embodiments of the interface 330 may have non-straight geometries.

Figure 8:
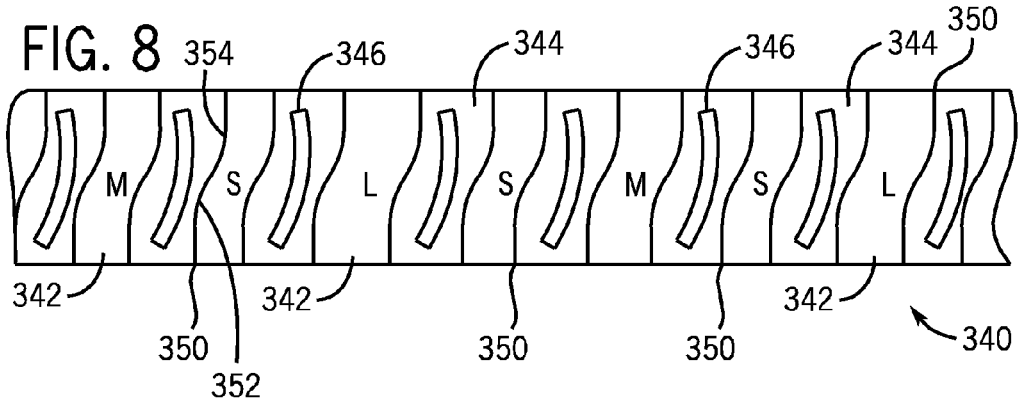
FIG. 8 is a top view of an embodiment of a rotor with differently sized spacers between blades.

FIG. 8 is a top view of an embodiment of a rotor 340 with differently sized spacers 342 between bases 344 of blades 346. Similar to the embodiment of FIGS. 6 and 8, the differently sized spacers 342 enable implementation of a variety of non-uniform blade spacing configurations with equally sized bases 344 and/or blades 346, thereby reducing manufacturing costs of the blades 346. Although any number and size of spacers 342 may be used to provide the non-uniform blade spacing, the illustrated embodiment includes three differently sized spacers 342 for purposes of discussion. The illustrated spacers 342 include a small spacer labeled as "S", a medium spacer labeled as "M", and a large spacer labeled as "L." The size of the spacers 342 may vary in a circumferential direction, as discussed above with reference to FIG. 6. The differently sized spacers 342 (e.g., S, M, and L) also may be arranged in a variety of repeating patterns, or they may be arranged in a random order.

In the illustrated embodiment, the spacers 342 interface with the bases 344 of the blades 346 at a non-straight interface 350. For example, the interface 350 may include a first curved portion 352 and a second curved portion 354, which may be the same or different from one another. However, the interface 350 also may have other non-straight geometries, such as multiple straight segments of different angles, one or more protrusions, one or more recesses, or a combination thereof. As illustrated, the first and second curved portions 352 and 354 curve in opposite directions from one another. However, the curved portions 352 and 354 may define any other curved geometry.

Figure 9:
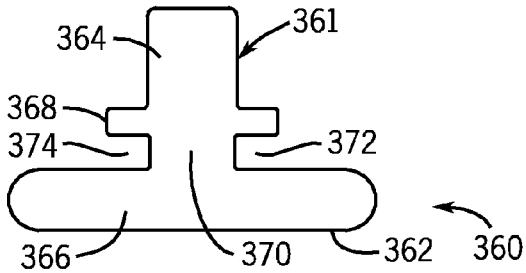
FIG. 9 is a front view of an embodiment of a blade having a T-shaped geometry.

FIG. 9 is a front view of an embodiment of a blade 360 having a T-shaped geometry 361, which may be arranged in a non-uniform blade spacing in accordance with the disclosed embodiments. The illustrated blade 360 includes a base portion 362 and a blade portion 364, which may be integral with one another (e.g., one-piece). The base portion 362 includes a first flange 366, a second flange 368 offset from the first flange 366, a neck 370 extending between the flanges 366 and 368, and opposite slots 372 and 374 disposed between the flanges 366 and 368. During assembly, the flanges 366 and 368 and slots 372 and 374 are configured to interlock with a circumferential rail structure about the rotor. In other words, the flanges 366 and 368 and slots 372 and 374 are configured to slide circumferentially into place along the rotor, thereby securing the blade 360 in the axial and radial directions. In the embodiments of FIGS. 6-8, these blades 360 may be spaced apart in the circumferential direction by a plurality of differently sized spacers having a similar base portion, thereby providing a non-uniform blade spacing of the blades 360.

Figure 10:
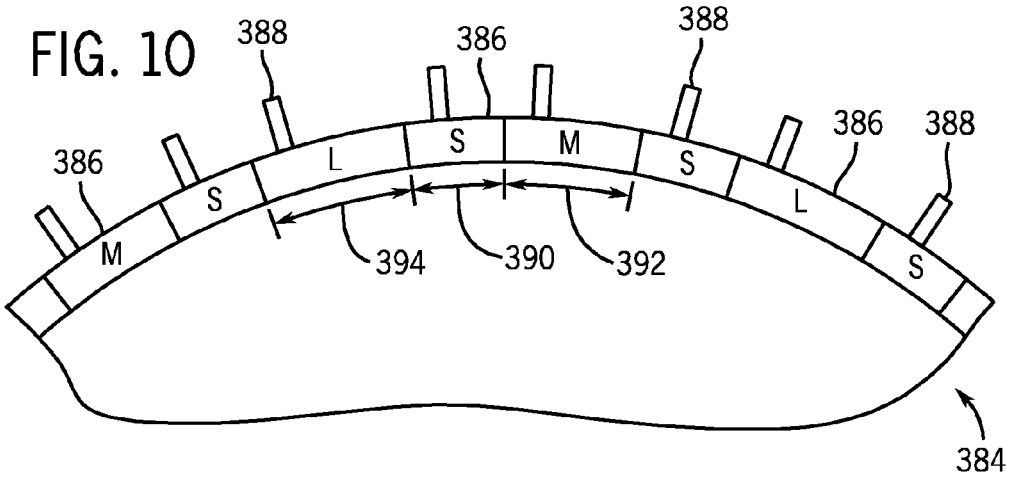
FIG. 10 is a section of a front view of an embodiment of a rotor with blades having differently sized bases.

FIG. 10 is a section of a front view of an embodiment of a rotor 384 with differently sized bases 386 of blades 388. In particular, the differently sized bases 386 enable implementation of a variety of non-uniform blade spacing configurations with or without spacers. If spacers are used with the differently sized bases 386, the spacers may be equally sized or differently sized to provide more flexibility in the non-uniform blade spacing. Although any number of differently sized bases 386 may be used to provide the non-uniform blade spacing, the illustrated embodiment includes three differently sized bases 386 for purposes of discussion. The illustrated bases 386 include a small base labeled as "S", a medium base labeled as "M", and a large base labeled as "L." The size of the bases 386 may vary in a circumferential direction, as indicated by dimension 390 for the small base, dimension 392 for the medium base, and dimension 394 for the large base. For example, these dimensions 390, 392, and 394 may progressively increase by a percentage of approximately 1 to 1000 percent, 5 to 500 percent, or 10 to 100 percent. In other embodiments, the rotor 384 may include more of fewer differently sized bases 386, e.g., 2 to 100, 2 to 50, 2 to 25, or 2 to 10. The differently sized bases 386 (e.g., S, M, and L) also may be arranged in a variety of repeating patterns, or they may be arranged in a random order.

Figure 11:
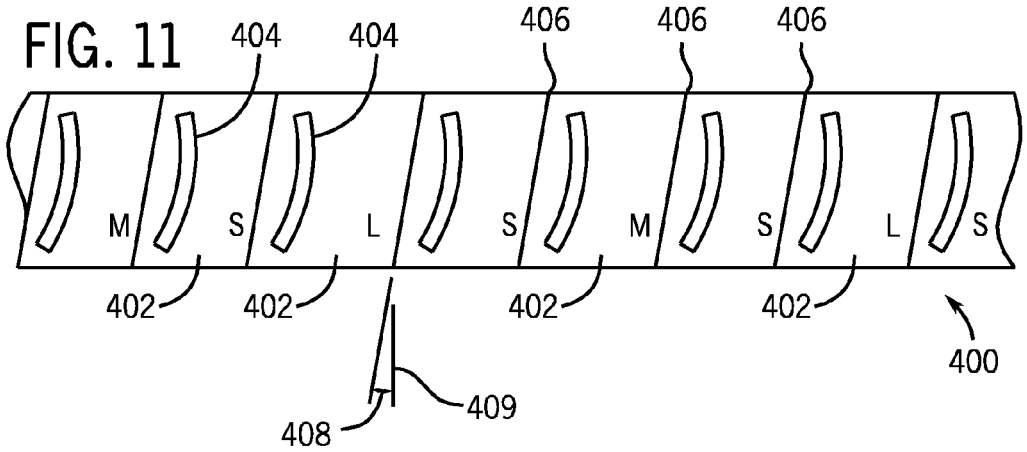
FIG. 11 is a top view of an embodiment of a rotor with blades having differently sized bases.

FIG. 11 is a top view of an embodiment of a rotor 400 with differently sized blade bases 402 supporting blades 404. Similar to the embodiment of FIG. 10, the differently sized bases 402 enable implementation of a variety of non-uniform blade spacing configurations with or without spacers. Although any number and size of bases 402 may be used to provide the non-uniform blade spacing, the illustrated embodiment includes three differently sized bases 402 for purposes of discussion. The illustrated bases 402 include a small base labeled as "S", a medium base labeled as "M", and a large base labeled as "L." The size of the bases 402 may vary in a circumferential direction, as discussed above with reference to FIG. 10. The differently sized bases 402 (e.g., S, M, and L) also may be arranged in a variety of repeating patterns, or they may be arranged in a random order.

In the illustrated embodiment, the bases 402 interface with one another at an angled interface 406. For example, the angled interface 406 is oriented at an angle 408 relative to a rotational axis of the rotor 400, as indicated by line 409. The angle 408 may range between approximately 0 to 60 degrees, 5 to 45 degrees, or 10 to 30 degrees. The illustrated angled interface 406 is a straight edge or flat surface. However, other embodiments of the interface 406 may have non-straight geometries.

Figure 12:
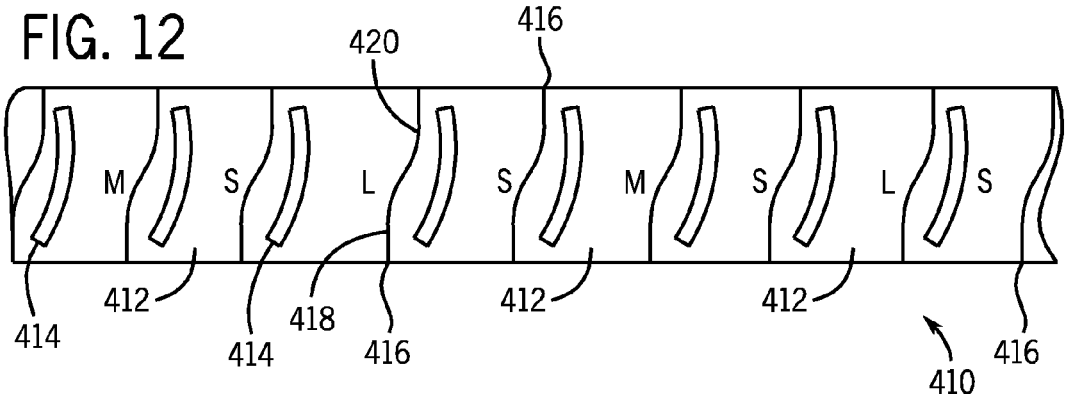
FIG. 12 is a top view of an embodiment of a rotor with blades having differently sized bases.

FIG. 12 is a top view of an embodiment of a rotor 410 with differently sized blade bases 412 supporting blades 414. Similar to the embodiment of FIGS. 10 and 12, the differently sized bases 412 enable implementation of a variety of non-uniform blade spacing configurations with or without spacers. Although any number and size of bases 412 may be used to provide the non-uniform blade spacing, the illustrated embodiment includes three differently sized bases 412 for purposes of discussion. The illustrated bases 412 include a small base labeled as "S", a medium base labeled as "M", and a large base labeled as "L." The size of the bases 412 may vary in a circumferential direction, as discussed above with reference to FIG. 10. The differently sized bases 412 (e.g., S, M, and L) also may be arranged in a variety of repeating patterns, or they may be arranged in a random order.

In the illustrated embodiment, the bases 412 interface with one another at a non-straight interface 416. For example, the interface 416 may include a first curved portion 418 and a second curved portion 420, which may be the same or different from one another. However, the interface 416 also may have other non-straight geometries, such as multiple straight segments of different angles, one or more protrusions, one or more recesses, or a combination thereof. As illustrated, the first and second curved portions 418 and 420 curve in opposite directions from one another. However, the curved portions 418 and 420 may define any other curved geometry.

Figure 13:
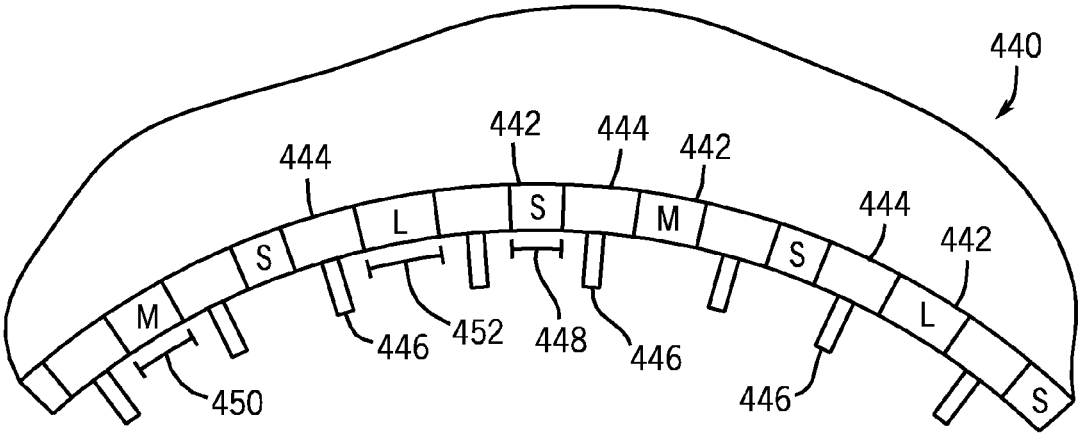
FIG. 13 is a section of a front view of an embodiment of a stator with differently sized spacers between bases of the vanes.

While the discussion above focused on rotors the principles are equally applicable to stators. FIG. 13 is a section of a front view of an embodiment of a stator 440 with differently sized spacers 442 between bases 444 of vanes 446. In particular, the differently sized spacers 442 enable implementation of a variety of non-uniform vane spacing configurations with equally sized bases 444 and/or vanes 446, thereby reducing manufacturing costs of the vanes 446. Although any number and size of spacers 442 may be used to provide the non-uniform vane spacing, the illustrated embodiment includes three differently sized spacers 442 for purposes of discussion. The illustrated spacers 442 include a small spacer labeled as "S", a medium spacer labeled as "M", and a large spacer labeled as "L." The size of the spacers 442 may vary in a circumferential direction, as indicated by dimension 448 for the small spacer, dimension 450 for the medium spacer, and dimension 452 for the large spacer. In certain embodiments, a plurality of spacers 442 may be disposed between adjacent bases 444, wherein the spacers 442 are either of equal or different sizes. In other words, the differently sized spacers 442 may be either a one-piece construction or a multi-piece construction using a plurality of smaller spacers to generate a greater spacing. In either embodiment, the dimensions 448, 450, and 452 may progressively increase by a percentage of approximately 1 to 1000 percent, 5 to 500 percent, or 10 to 100 percent. In other embodiments, the stator 310 may include more or fewer differently sized spacers 442, e.g., 2 to 100, 2 to 50, 2 to 25, or 2 to 10. The differently sized spacers 442 (e.g., S, M, and L) also may be arranged in a variety of repeating patterns, or they may be arranged in a random order.

Figure 14:
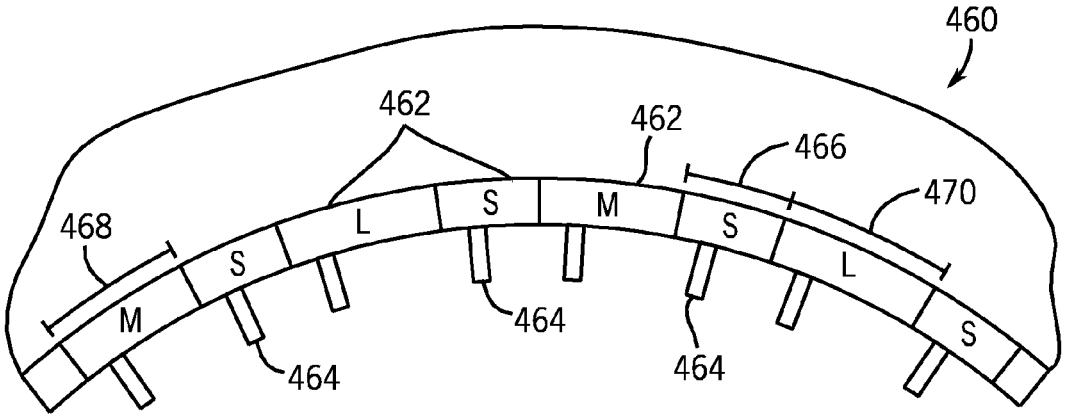
FIG. 14 is a section of a front view of an embodiment of a stator with differently sized vane bases.

FIG. 14 is a section of a front view of an embodiment of a stator 460 with differently sized bases 462 of vanes 464. In particular, the differently sized bases 462 enable implementation of a variety of non-uniform vane spacing configurations with or without spacers. If spacers are used with the differently sized bases 462, the spacers may be equally sized or differently sized to provide more flexibility in the non-uniform vane spacing. Although any number of differently sized bases 462 may be used to provide the non-uniform vane spacing, the illustrated embodiment includes three differently sized bases 462 for purposes of discussion. The illustrated bases 462 include a small base labeled as "S", a medium base labeled as "M", and a large base labeled as "L." The size of the bases 462 may vary in a circumferential direction, as indicated by dimension 466 for the small base, dimension 468 for the medium base, and dimension 470 for the large base. For example, these dimensions 466, 468, and 470 may progressively increase by a percentage of approximately 1 to 1000 percent, 5 to 500 percent, or 10 to 100 percent. In other embodiments, the stator 460 may include more of fewer differently sized bases 462, e.g., 2 to 100, 2 to 50, 2 to 25, or 2 to 10. The differently sized bases 462 (e.g., S, M, and L) also may be arranged in a variety of repeating patterns, or they may be arranged in a random order.

Technical effects of the disclosed embodiments of the invention include the ability to non-uniformly space blades and/or vanes on a respective rotor and stator of a rotary machine, such as a compressor or a turbine. The non-uniform blade and vane spacing may be achieved with differently sized spacers between adjacent blades and vanes, differently sized bases supporting blades and vanes, or a combination thereof. The non-uniform blade and vane spacing also may be applied to multiple stages of a rotary machine, such as multiple turbine stages or multiple compressor stages. For example, each stage may have non-uniform blade or vane spacing, which may be the same or different from other stages. In each of these embodiments, the non-uniform blade and vane spacing is configured to reduce the possibility of resonance due to periodic generation of wakes and bow waves. Furthermore, the non-uniform spacing may effectively dampen and reduce the response of structures impacted by the wake and bow waves due to their non-periodic generation by the blades. In this manner, the non-uniform blade and/or vane spacing is able to lessen the impact of wakes and bow waves on various downstream and/or upstream components, e.g., vanes, blades, nozzles, stators, airfoils, rotors etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a rotary machine comprising:

a stator; and a rotor configured to rotate relative to the stator, wherein the rotor comprises at least four equally sized sectors about a circumference of the rotor, wherein each of the sectors comprises a different number of blades.

2. The system of claim 1, wherein a non-uniform spacing of the plurality of blades is configured to reduce resonant behavior in the rotary machine.

3. The system of claim 1, wherein the rotary machine comprises a turbine having the stator and the rotor.

4. The system of claim 1, wherein the rotary machine comprises a compressor having the stator and the rotor.

5. The system of claim 1, comprising a plurality of blades having a non-uniform spacing defined by a plurality of spacers with different widths in a circumferential direction about a circumference of the rotor, and each spacer of the plurality of spacers is disposed circumferentially between adjacent blades of the plurality of blades.

6. The system of claim 1, comprising a plurality of blades having a non-uniform spacing defined by a plurality of blade platforms with different widths in a circumferential direction about a circumference of the rotor, and each blade of the plurality of blades is coupled to a respective platform of the plurality of blade platforms.

7. A system, comprising:

a rotary machine comprising:

a first stage comprising a plurality of first blades configured to rotate about an axis; and a second stage comprising a plurality of second blades configured to rotate about the axis, wherein the plurality of second blades is offset relative to the plurality of first blades along the axis, and at least one of the plurality of first blades or the plurality of second blades has a non-uniform blade spacing about the axis, wherein the non-uniform blade spacing is defined by a plurality of blade platforms having different widths in a circumferential direction about the axis, and wherein each platform of the plurality of blade platforms comprises a single blade coupled to each platform.

8. The system of claim 7, wherein the non-uniform blade spacing is configured to reduce resonant behavior in the rotary machine.

9. The system of claim 7, wherein the rotary machine comprises a turbine, a compressor, or a combination thereof.

10. The system of claim 7, wherein the non-uniform blade spacing is further defined by a plurality of spacers having different widths in a circumferential direction about the axis, and each spacer of the plurality of spacers is disposed circumferentially between adjacent blades of the plurality of first blades or the plurality of second blades.

11. The system of claim 7, wherein the non-uniform blade spacing is defined by a plurality of equal sized sectors about the axis, and each sector of the plurality of equal sized sectors includes a different number of blades of the plurality of first blades or the plurality of second blades.

12. The system of claim 7, wherein the plurality of first blades has a first non-uniform blade spacing about the axis, and the plurality of second blades has a second non-uniform blade spacing about the axis.

13. A system, comprising:

a first turbine blade set comprising:

a plurality of first blades coupled to a turbine engine about a first axis, wherein at least some of the plurality of first blades have first blade platforms with different first widths in a first circumferential direction about the first axis to define a first non-uniform blade spacing, and each of the first blade platforms has a single first blade coupled to the first blade platform.

14. The system of claim 13, comprising a second turbine blade set comprising: a plurality of second blades configured to couple to the turbine engine about a second axis, wherein at least some of the plurality of second blades have second blade platforms with different second widths in a second circumferential direction about the second axis to define a second non-uniform blade spacing, and each of the second blade platforms has a single second blade coupled to the second blade platform.

15. The system of claim 14, wherein the first or second non-uniform blade spacing is defined by a plurality of equal sized sectors about the first or second axis, and each sector of the plurality of equal sized sectors includes a different number of blades of the plurality of first blades or the plurality of second blades.

16. The system of claim 1, wherein a blade spacing within one of the sectors is uniform.

17. The system of claim 1, wherein one or more sectors alternate between increasing and decreasing a blade spacing.

18. The system of claim 7, wherein the widths of the plurality of blade platforms changes circumferentially about the axis in one or more patterns.

19. The system of claim 7, wherein the widths of the plurality of blade platforms alternate between increasing and decreasing widths.

20. The system of claim 13, wherein the plurality of first blades are configured to rotate about the first axis.

* * * * *